US008850847B2

(12) United States Patent
Lee

(10) Patent No.: US 8,850,847 B2
(45) Date of Patent: Oct. 7, 2014

(54) AIR CONDITIONER

(75) Inventor: Sanghun Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 610 days.

(21) Appl. No.: 12/992,460

(22) PCT Filed: May 4, 2009

(86) PCT No.: PCT/KR2009/002358

§ 371 (c)(1),
(2), (4) Date: Nov. 12, 2010

(87) PCT Pub. No.: WO2010/128695

PCT Pub. Date: Nov. 11, 2010

(65) Prior Publication Data

US 2011/0061422 A1 Mar. 17, 2011

(30) Foreign Application Priority Data

May 4, 2009 (KR) ..... 10-2009-0038885

(51) Int. Cl.
*F25B 1/00* (2006.01)
*F25B 43/00* (2006.01)
*F25B 41/04* (2006.01)

(52) U.S. Cl.
CPC ..... *F25B 43/006* (2013.01); *F25B 2400/01* (2013.01); *F25B 41/04* (2013.01); *F25B 2400/13* (2013.01)
USPC ..... 62/498; 219/541; 392/480

(58) Field of Classification Search
USPC ..... 62/498; 392/480
See application file for complete search history.

(56) References Cited

U.S. PATENT DOCUMENTS

| | | | | |
|---|---|---|---|---|
| 5,377,495 | A * | 1/1995 | Daigle | 62/125 |
| 6,449,967 | B1 * | 9/2002 | Dube | 62/156 |
| 6,467,284 | B1 * | 10/2002 | Chen et al. | 62/156 |
| 6,490,882 | B2 * | 12/2002 | Tipton | 62/498 |
| 6,837,061 | B2 * | 1/2005 | Kadle et al. | 62/158 |
| 2006/0240179 | A1 * | 10/2006 | Sasaki et al. | 427/77 |
| 2007/0205450 | A1 * | 9/2007 | Okita | 257/296 |
| 2007/0272653 | A1 * | 11/2007 | Wakita | 216/13 |

FOREIGN PATENT DOCUMENTS

| | | | | |
|---|---|---|---|---|
| JP | 01-302078 | | 12/1989 | |
| JP | 07-324828 | | 12/1995 | |
| JP | 2004063232 | A * | 2/2004 | H05B 3/00 |
| KR | 20-1997-0018909 | | 5/1997 | |
| WO | WO 2005-040066 | | 5/2005 | |

OTHER PUBLICATIONS

Yeo-Hwan Yoon, Transparent Film Heater Using Single-Walled Carbon Nanotubes, Aug. 14, 2007, Advanced Materials, Wiley InterScience, pp. 4284-4287.*

(Continued)

*Primary Examiner* — Cheryl J Tyler
*Assistant Examiner* — David Teitelbaum
(74) *Attorney, Agent, or Firm* — KED & Associates, LLP

(57) ABSTRACT

An air conditioner may include: a compressor; a condenser; an expander; a bypass pipe that bypasses the refrigerant discharged from the condenser to an inlet side of the compressor; a refrigerant heating apparatus that heats the refrigerant flowing in the bypass pipe; and a valve that controls the refrigerant flowing in the bypass pipe. The refrigerant heating apparatus may include: a refrigerant pipe in which the refrigerant flows; and a heating unit that is provided on an outer surface of the refrigerant pipe and has a carbon nanotube heating element that is heat-generated by itself by a supplied power.

8 Claims, 4 Drawing Sheets

(56) References Cited

OTHER PUBLICATIONS

Tech Tip 14, Suction Line Accumulator, Jan. 8, 2007, Henry Technologies, pp. 1-2.*

Hasegawa Abstract, 2 pages.*

International Search Report issued in PCT/KR2009/002358 dated May 26, 2010.

* cited by examiner

AIR CONDITIONER

TECHNICAL FIELD

The embodiment relates to an air conditioner.

BACKGROUND ART

An air conditioner is a home appliance to maintain indoor air in an optimum state according to a use and a purpose. For example, the air conditioner controls the interior of a room to a cooling state in summer and the interior of a room to a heating state in winter.

DISCLOSURE

Technical Problem

An object of the embodiment provides an air conditioner that increases heating efficiency upon performing heating operation.

In addition, another object of the embodiment heats a refrigerant and bypasses it to an inlet side of a compressor.

Technical Solution

An air conditioner according to one embodiment includes: a compressor that compresses a refrigerant; a condenser that condenses the refrigerant compressed in the compressor; an expander that expands the refrigerant condensed in the condenser; an evaporator that evaporates the refrigerant expanded in the expander; a bypass pipe that bypasses the refrigerant discharged from the condenser to an inlet side of the compressor; a refrigerant heating apparatus that heats the refrigerant flowing in the bypass pipe; and a valve that controls the refrigerant flowing in the bypass pipe, wherein the refrigerant heating apparatus includes: a refrigerant pipe in which the refrigerant flows; and a heating unit that is provided on an outer surface of the refrigerant pipe and has a carbon nanotube heating element that is heat-generated by itself by a supplied power.

An air conditioner according to another embodiment includes: a compressor that compresses a refrigerant; a condenser that condenses the refrigerant compressed in the compressor; an expander that expands the refrigerant condensed in the condenser; an evaporator that evaporates the refrigerant expanded in the expander; an accumulator that has the refrigerant, which is discharged from the evaporator, flowing therein and separates a gas refrigerant and a liquid refrigerant; and a heating unit that is provided on an outer surface of the accumulator and has a carbon nanotube heating element that is heat-generated by itself by a supplied power.

Advantageous Effects

With the above-mentioned embodiments, when the air conditioner is operated in the state where an outdoor temperature is very low, the degradation of the heating performance can be prevented as the refrigerant discharged from the condenser is sucked into the compressor in the state where the refrigerant is heated by the carbon nanotube (CNT) heating element.

In addition, even when the accumulator that separates the liquid refrigerant and the gas refrigerant discharged from the evaporator is heated by the CNT heating element, the degradation of the heating performance can be prevented. Further, as the CNT heating element is used as a heating source for heating the refrigerant, the size and manufacturing cost of the heating unit can be reduced and the size of the air conditioner can thus be reduced.

Moreover, the carbon nanotube is coated on a heated body, such that it is possible to form the CNT heating element on a heated body having various shapes.

Also, as the plurality of CNT heating elements are disposed to be spaced from each other, even when any one CNT heating element is damaged, the refrigerant can be continuously heated.

BEST MODE

Hereinafter, exemplary embodiments will be described in detail with reference to the accompanying drawings.

Figure 1:
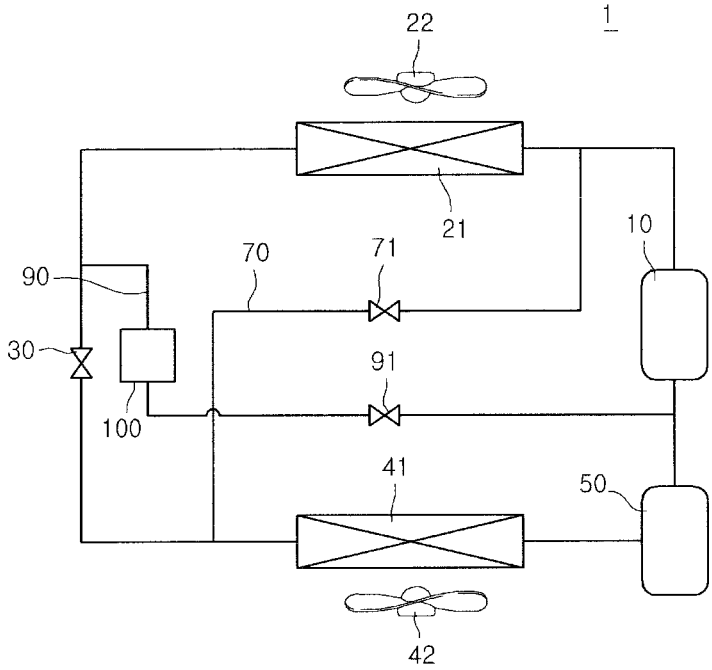
FIG. 1 is a diagram showing a refrigerant cycle of an air conditioner according to a first embodiment.

FIG. 1 is a diagram showing a refrigerant cycle of an air conditioner according to a first embodiment.

The embodiment will described each component based on a refrigerant flow upon performing a heating operation as one example.

Referring to FIG. 1, an air conditioner 1 according to the embodiment includes a compressor 10 that compresses a refrigerant, an indoor heat exchanger 21 in which the compressed refrigerant from the compressor 10 flows; an indoor fan 22 that ventilates the heat exchanged air to the interior of a room; an expander 30 that expands the refrigerant discharged from the indoor heat exchanger; an outdoor heat exchanger 41 that heat-exchanges the expanded refrigerant with an outdoor air; and an outdoor fan 42 that ventilates the heat exchanged air to the outside.

In detail, while the heating cycle is performed, the indoor heat exchanger 21 is operated as a condenser and an outdoor heat exchanger 41 is operated as an evaporator.

An accumulator 50, which sends only a gas refrigerant of refrigerants discharged from the outdoor heat exchanger 41 to the compressor 10, is disposed between the compressor 10 and the outdoor heat exchanger 41.

In addition, a first bypass pipe 70, which bypasses a high-temperature and high-pressure refrigerant compressed in the compressor 10 to an inlet side of the outdoor heat exchanger 41, is connected between the indoor heat exchanger 21 and the compressor 10.

One end of the first bypass pipe 70 is connected to a pipe that connects the indoor heat exchanger 21 with the compressor 10, and the other thereof is connected to a pipe that connects the outdoor heat exchanger 41 with the expander 30.

In addition, the first bypass pipe 70 is provided with a first valve 71 that controls the bypassed refrigerant amount. At this time, the first bypass pipe 70 may be provided with a capillary that decompresses the refrigerant.

The first valve 71 is opened when the defrosting operation condition is satisfied during the heating operation of the air conditioner.

In addition, a second bypass pipe 90, which bypasses the refrigerant discharged from the indoor heat exchanger 21 to the inlet side of the compressor 10, is connected between the indoor heat exchanger 21 and the expander 30.

One end of the second bypass pipe 90 is connected to the pipe that connects the indoor heat exchanger 21 with the expander 30 and the other thereof is connected to the pipe that connects the accumulator 50 with the compressor 10. Unlike this, other end of the second bypass pipe 90 may be connected to the pipe that connects the outdoor heat exchanger 41 with the accumulator 50.

The second bypass pipe 90 is provided with a refrigerant heating apparatus 100 that heats the refrigerant discharged from the indoor heat exchanger 21. In addition, the second bypass pipe 90 is provided with a second valve 91 that controls the bypassed refrigerant amount.

When the outdoor temperature is very low, the second valve 91 is opened and the refrigerant heating apparatus 100 is operated. When the air conditioner is used in a cold area, the refrigerant can be heated by the refrigerant heating apparatus since the outdoor temperature is low.

Hereinafter, an operation of the air conditioner will be described simply. When the air conditioner performs a heating operation, the high-temperature and high-pressure refrigerant is discharged from the compressor 10. The refrigerant discharged from the compressor 10 flows in the indoor heat exchanger 21 and is thus condensed. The condensed refrigerant discharged from the indoor heat exchanger 21 is expanded by passing through the expander 30. Also, the expanded refrigerant is evaporated by passing through the outdoor heat exchanger 41 and the evaporated refrigerant flows in the accumulator 50. Only the gas refrigerant flows from the accumulator 50 to the compressor 10. As described above, while the air conditioner is performs the heating operation, the first valve 71 and the second valve 91 are basically closed. When the defrosting of the outdoor heat exchanger 41, which is operated as the evaporator during the heating operation of the air conditioner, is needed, the first valve 71 is opened. In this case, the high-temperature refrigerant discharged from the compressor 10 is bypassed to the inlet side of the outdoor heat exchanger 41. At this time, the defrosting is performed while the high-temperature refrigerant moves the outdoor heat exchanger 41.

Figure 2:
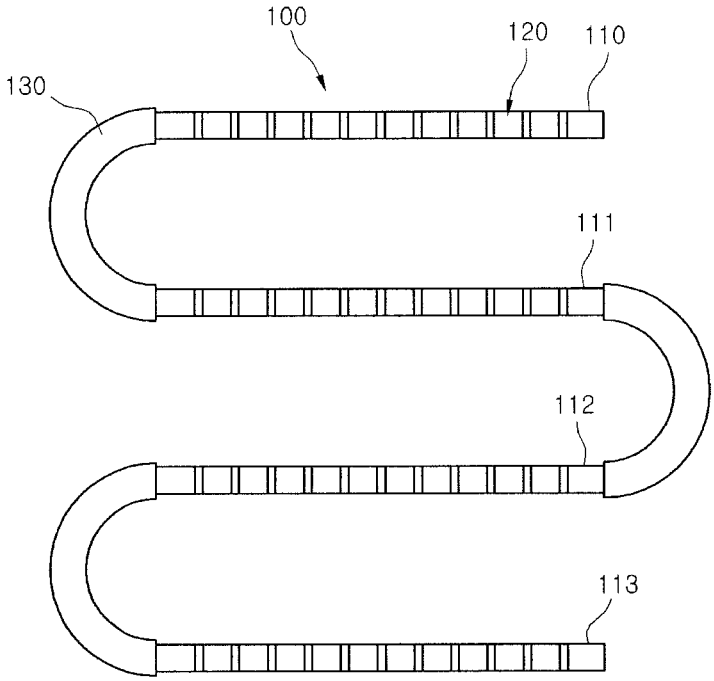
FIG. 2 is a diagram showing a refrigerant heating apparatus according to the first embodiment.

Meanwhile, when the air conditioner performs the heating operation in the state where the outdoor temperature is a reference temperature or less, the evaporation performance is degraded. When the evaporation performance is degraded, the refrigerant temperature at the inlet side of the compressor is lower than the required temperature, the heating performance can be degraded. In this case, the second valve 91 is opened in the state where the first valve 71 is closed. As a result, the condensed refrigerant discharged to the indoor heat exchanger 21 is bypassed to the first bypass pipe 90 and the bypassed refrigerant is heated while the bypassed refrigerant moves the refrigerant heating apparatus 100. The heated refrigerant moves to the inlet side of the compressor 10. Therefore, as the temperature-raised refrigerant is sucked into the compressor 10, the degradation of the heating performance can be prevented. Hereinafter, the refrigerant heating apparatus 100 will be described in detail. FIG. 2 is a diagram showing a refrigerant heating apparatus according to the first embodiment;

Referring to FIGS. 1 and 2, the refrigerant heating apparatus 100 according to the embodiment includes a plurality of refrigerant pipes 110, 111, 112, and 113 that moves the bypassed refrigerant and a connection pipe 130 that connects adjacent refrigerant pipes.

In detail, the cross section of the plurality of refrigerant pipes 110, 111, 112, and 113 may be formed in a circular shape and are not limited thereto. The plurality of refrigerant pipes 110, 111, 112, and 113 may include, for example, a first refrigerant pipe to a fourth refrigerant pipe. In the embodiment, the number of refrigerant pipes is not limited. However, FIG. 2 is shown as including four refrigerant pipes as one example.

The condensed refrigerant discharged from the indoor heat exchanger 21 may flow in one end of the first refrigerant pipe 110. The refrigerant discharged from one end of the fourth refrigerant pipe 113 may move to the inlet side of the compressor 10.

The connection pipe 130 is bent and is formed in an approximate "U" shape. Two adjacent refrigerant pipes may be bonded to the connection pipe 130 by, for example, welding.

The outer sides of each refrigerant pipes 110, 111, 112, and 113 are provided with heating units 120 that heats the refrigerant that moves each refrigerant pipe.

Figure 3:
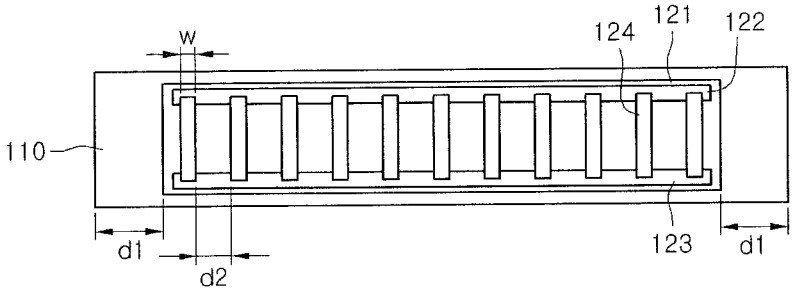
FIG. 3 is a development diagram of one refrigerant pipe according to the first embodiment.
Figure 4:
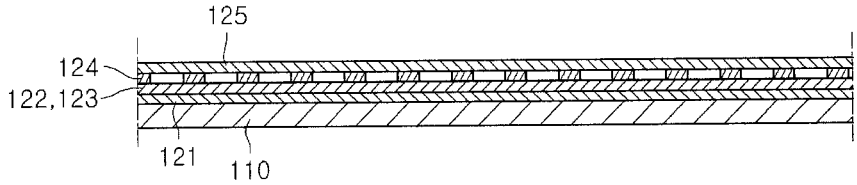
FIG. 4 is a cross-sectional view showing a structure of a heating unit according to the first embodiment.
Figure 5:
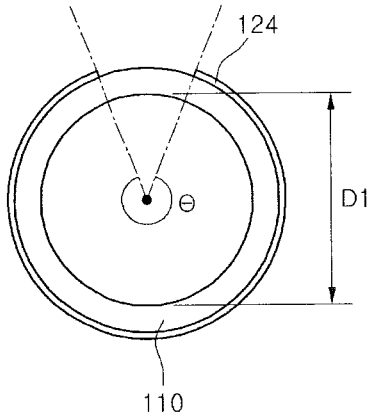
FIG. 5 is a diagram schematically showing a side view of the refrigerant pipe according to the first embodiment.

FIG. 3 is a development view of one refrigerant pipe according to the first embodiment, FIG. 4 is a cross-sectional view showing a structure of the heating unit, and FIG. 5 is a diagram schematically showing a side view of one refrigerant pipe according to the first embodiment.

Referring to FIGS. 2 to 5, the heating units 120 are fixed to outer surfaces of each refrigerant pipe 110, 111, 112, and 113. The heating units fixed to each refrigerant pipe have the same structure and therefore, the plurality of refrigerant pipes are collectively referred to reference numeral "110"

The heating unit 120 includes an insulating sheet 121 that is fixed to the outer surface of the refrigerant pipe 110, a pair of electrodes 122 and 123 that is fixed to the upper surface of the insulating sheet 121, a plurality of carbon nanotube heating elements 124 (hereinafter, referred to as 'NT heating element' that are fixed to the upper surfaces of the pair of electrodes 122 and 123, and anti-oxidation layers 125 that are fixed to the upper surfaces of the plurality of CNT heating elements 124.

In detail, the insulating sheet 121 performs a role of easily fixing the CNT heating element 124 to the refrigerant pipe 110.

The pair of electrodes 122 and 123 is disposed in parallel in the state where they are spaced from each other. The pair of electrodes 122 and 123 is a part that supplies power to the plurality of CNT heating elements 124 and any one thereof corresponds to an anode and the other corresponds to a cathode. Each electrode 122 and 123 is connected to an electric wire.

In the embodiment, the pair of electrodes 122 and 123 is lengthily extended along a length direction (direction in parallel with a center of the refrigerant pipe) of the refrigerant pipe 110. Therefore, the pair of electrodes 122 and 123 is spaced in a circumferential direction of the refrigerant pipe 110.

The plurality of CNT heating element 124 may complete in a rectangular shape but the shape thereof is not limited thereto. One end of each CNT heating element 124 contacts the upper surface of one electrode 122 and the other contacts the upper surface of another electrode 123.

The plurality of CNT heating elements 124 are disposed to be spaced by a predetermined interval d2 in a length direction of the refrigerant pipe 100

The refrigerant pipes 110, 111, 112, and 113 may be a copper pipe, an aluminum pipe, or a steel pipe.

The CNT heating element 124 indicates a heating element made of a carbon nanotube. The carbon nanotube means a material that hexagons formed of 6 carbons connects to each other to form a pipe shape.

In detail, the carbon nanotube is lightweight and has excellent electrical resistance. Further, the thermal conductivity of carbon nanotube is 1600 to 6000 W/mK, which is excellent as compared to the thermal conductivity of copper that is 400 W/mK. In addition, the electrical resistance of the carbon nanotube is $10^{-4}$~$10^{-5}$ ohm/cm, which is similar to the electrical resistance of copper. The embodiment uses the properties of the carbon nanotube as a heating source for heating a refrigerant.

After the carbon nanotube is fixed (for example, coated) on the insulating sheet 122, current is applied to the pair of electrodes 122 and 123 such that the carbon nanotube is heated. In the embodiment, the state where the carbon nanotube is coated on the insulating sheet 121 may be referred to the CNT heating element 124.

When the CNT heating element 124 is applied as the heating source of the refrigerant, the CNT heating element 124 can be semi-permanently used and the shape processing can be easily performed such that the CNT heating element 124 can be applied to the refrigerant pipe. In addition, when the CNT heating element 124 is applied as the heating source of the refrigerant, the volume of the heating unit can be reduced and the refrigerant can be heated early.

In other words, when the CNT heating element uses a positive temperature coefficient (PTC) element, a sheathe heater, etc. as the heating source, the volume thereof can be greatly reduced and the cost for generating power as much as 1 kw can be reduced.

Moreover, as the plurality of CNT heating elements 124 are disposed around the refrigerant pipe 110, even when any one CNT heating element is damaged, the refrigerant pipe can be continuously heated.

Meanwhile, the width w of the CNT heating element 124 is formed to be equal to or larger than an interval d2 between the adjacent CNT heating elements 124. In the embodiment, when the lengths of the length and breadth of the CNT heating element are not equal to each other, the length of the short side may be defined as a width and when the lengths of the length and breadth of the CNT heating element are equal to each other, a length of any one side may be defined as a width.

In detail, since the CNT heating element 124 has a large electrical resistance, the heat value becomes large despite a narrow contact area (a contact area of the CNT heating element and the refrigerant pipe).

In the state where the heat capacity of the heating unit of the refrigerant pipe 110 is maintained constantly (for example, 4 kw per one refrigerant pipe), since a case where the interval between the CNT heating elements 124 is narrow heats (may be referred to local heating) the refrigerant only in some areas of the refrigerant pipe 110 as compared to a case where the interval between the CNT heating elements 124 is large, there is a problem in that the boiling of the refrigerant occurs.

Therefore, in order to prevent the boiling of the refrigerant due to the local heating, in the embodiment, the width w of the CNT heating element 124 is formed to be equal to or smaller than the interval d2 between the adjacent CNT heating elements. FIG. 3 shows that the interval d2 between the CNT heating elements is, for example, larger than the width w of the CNT heating element 124.

In addition, whether or not the boiling of the refrigerant is related to the contact area of the CNT heating element 124 and the refrigerant pipe 110. When intending to form the heating unit 120 in the same capacity, if the contact area of the CNT heating element 124 and the refrigerant pipe 110 is increased, the thickness of the CNT heating element 124 is reduced. On the other hand, when the thickness of the CNT heating element 124 is increased, the contact are of the CNT heating element 124 and the refrigerant pipe 110 is reduced. When comparing the above-mentioned two cases, as the thickness of the CNT heating element is large and the contact area of the CNT heating element and the refrigerant pipe can be reduced, the surface temperature of the CNT heating element is large and the heat concentration phenomenon is large, such that the boiling phenomenon of the refrigerant may occur and the bending phenomenon of the refrigerant pipe may occur.

Therefore, it is preferable that the contact area of the CNT heating element 124 and the refrigerant pipe 110 is increased. In other words, the length of the CNT heating element 124 surrounded along the circumference of the refrigerant pipe 110 (circumferential direction) is formed similar to the circumference of the refrigerant pipe. However, since the spaced distance between the pair of electrodes 122 and 123 is secured, an angle, which is formed by a line connecting the center of the refrigerant pipe 110 to one end of the CNT heating element 124 and a line connecting the center of the refrigerant pipe 110 to other end of the CNT heating element 124, has a smaller value than 355° when being viewed from FIG. 5.

The sum of the areas of the plurality of CNT heating elements is formed at 60% or less of an area calculated by a product of a distance between two CNT heating elements disposed at both ends of the plurality of CNT heating elements and a height of the CNT heating element (up and down length when being viewed from FIG. 3) by the spaced distance of the plurality of CNT heating elements and the angle of the CNT heating element formed in the circumferential direction of the refrigerant pipe.

In addition, whether or not the boiling of the refrigerant is related to the refrigerant amount that moves the inside of the refrigerant pipe. In detail, when the hate having the same capacity is applied to the refrigerant pipe, the case where the diameter of the refrigerant pipe is small has a higher possibility of the boiling than the case where the diameter thereof is large. In other words, a case where the refrigerant amount is small has a higher possibility of the boiling of refrigerant than the case where the refrigerant amount is small.

Therefore, in the embodiment, a diameter D1 of the refrigerant pipe is formed to be larger than 15.88 mm (or ⅝ inches). As one example, the diameter D1 of the refrigerant pipe may be formed at 25.44 mm (or 1 inch).

In addition, whether or not the boiling of the refrigerant is related to the thickness of the refrigerant pipe. The case where the thickness of the refrigerant pipe is thick has a higher possibility of the generation of boiling than the case where the thickness thereof is thin.

Therefore, in the embodiment, the thickness of the refrigerant pipe 110 may be formed at 2 mm or more.

Meanwhile, the two adjacent refrigerant pipes as described above can be connected to the connection part 130 and each refrigerant pipe and the connection part 130 are bonded to each other by welding. However, when the refrigerant pipe 120 and the connection part 130 are welded in the state where the heating unit 120 is fixed to the refrigerant pipe 120, the heating unit (in particular, electrode) may be damaged by welding heat. Therefore, in order to prevent the damage of the heating unit during the welding, the heating unit 120 may be disposed to be spaced by the predetermined interval d1 from each end of the refrigerant pipe. The predetermined interval d1 may be 50 mm or more.

Although the embodiment describes that two refrigerant pipes are connected by the connection part by way of example, one end of each refrigerant pipe may be connected to a first header and the other of each refrigerant pipe may be connected to a second header. In this case, the heating unit is disposed to be spaced by 50 mm or more from each end of the refrigerant pipes.

The structure that the plurality of refrigerant pipes are communicated with each other by the header is the same as the known structure and therefore, the detailed description therefore will be omitted.

MODE FOR INVENTION

Figure 6:
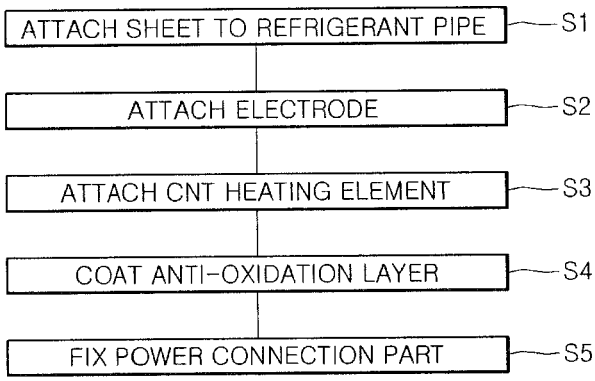
FIG. 6 is a flow chart for describing a method for manufacturing the refrigerant heating apparatus according to the first embodiment.

FIG. 6 is a flow chart for describing a method for manufacturing the refrigerant heating apparatus according to the first embodiment.

Referring to FIGS. 4 and 6, the plurality of refrigerant pipes are first prepared. Then, the refrigerant pipe is provided with the heating unit 120. In detail, the insulating sheet is coated around the refrigerant pipe (S1). Then, the pair of electrodes 122 and 123 are fixed to the upper surface of the insulating sheet 121 (S2). The matter that the pair of electrodes 122 and 123 are disposed to be spaced from each other is already described. Thereafter, the plurality of CNT heating elements 124 are disposed to be spaced by a predetermined interval on the upper surface of the electrode (S3). Next, the anti-oxidation layer 125 is coated on the upper surface o the plurality of CNT heating elements 124 (S4). Finally, the power connection part (electric wire) is fixed to the pair of electrodes (S5). When the connection and the plurality of refrigerant pipes are connected with each other by the welding and finally, the refrigerant heating apparatus completes.

Figure 7:
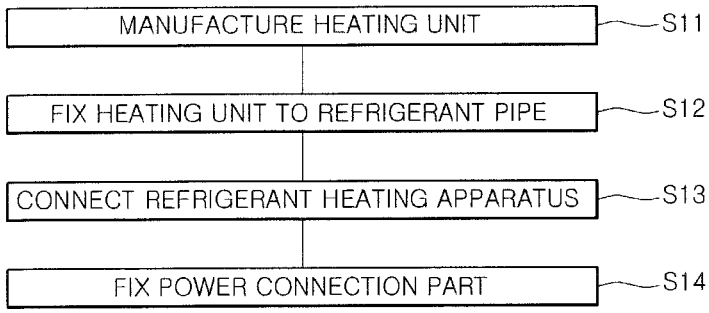
FIG. 7 is a flow chart for describing a method for manufacturing a refrigerant heating apparatus according to a second embodiment and a method for connecting to other components of an air conditioner.

FIG. 7 is a flow chart for describing a method for manufacturing a refrigerant heating apparatus according to a second embodiment and a method for connecting to other components of an air conditioner;

Referring to FIG. 7, the heating unit according to the embodiment is manufactured in a separate article and is fixed to the refrigerant pipe. In detail, each of the refrigerant pipe 110 and the heating unit 120 is first prepared (S11). The heating unit is a member that the insulating sheet, the pair of electrodes, the plurality CNT heating elements, and the anti-oxidation layer, which are described in the first embodiment, are sequentially formed. Then, the heating unit 110 is fixed to the refrigerant pipe 110 (S12). Then, the connection part and the plurality of refrigerant pipes are connected to each other by the welding and thus, the refrigerant heating apparatus completes (S13). The refrigerant heating apparatus 100 is installed at the bypass pipe 90 (S13). Finally, the power connection part (electric wire) is fixed to the pair of electrodes (S14). In the embodiment, the order of steps S13 and S14 can be changed.

With the embodiment, since the heating unit manufactured as a separate article is fixed to the refrigerant pipe, the assembling time of the refrigerant heating apparatus is reduced and the assembling process is simplified.

Figure 8:
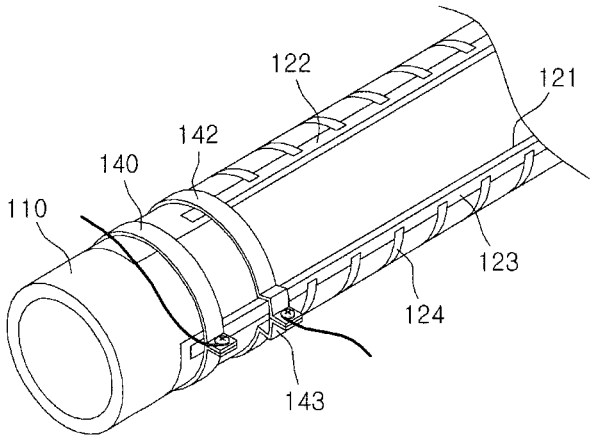
FIG. 8 is a perspective view showing a refrigerant pipe according to a third embodiment.

FIG. 8 is a perspective view showing a refrigerant pipe according to a third embodiment.

The configuration of the embodiment is the same as the configuration of the first embodiment but has a difference in the connection structure of the power connection part and the electrode. Therefore, only the feature part of the embodiment will be described.

Referring to FIG. 8, the refrigerant pipe 110 of the present embodiment is provided with the heating unit as described above. The heating unit includes the pair of electrodes 122 and 123 and any one 122 (first electrode) of the pair of electrodes 122 and 123 is formed to be smaller than the length (length direction of the refrigerant pipe) of another electrode 123 (second electrode). In other words, the distance from the end of the refrigerant pipe 110 to the first electrode is larger than the distance to the second electrode 123.

The pair of electrodes 122 and 123 and each power connection part (electric wire) can be electrically connected by the connection members 140 and 142. The connection members 140 and 142 may be formed of a conductive material.

The connection members 140 and 142 includes a first connection member 140 that connects the second electrode 123 to the power connection part and a second connection member 142 that connects the first electrode 122 to the power connection part. Each connection member 140 and 142 surrounds the entire refrigerant pipe.

The first connection member 140 contacts only the second electrode 123 in the state where the first connection member 140 surrounds the refrigerant pipe. Since The distance from the end of the refrigerant pipe 110 to the first electrode is larger than the distance to the second electrode 123, the second connection member 142 surrounds the refrigerant pipe so as to contact the first electrode, such that the second connection member 142 can contact the second electrode. Therefore, in the embodiment, in order to prevent the contact of the second connection member 142 and the second electrode, the second connection member is provided with an interval forming part 143.

With the embodiment, since each connection member 140 and 142 surrounds the upper surfaces of the electrodes 122 and 123 and the power connection part is connected to the connection members 140 and 142, the damage of the electrode due to heat generated during the welding coupling of the refrigerant pipe 110 and the connection part 130 can be prevented. In other words, the connection part performs a role of protecting the electrode from heat.

Figure 9:
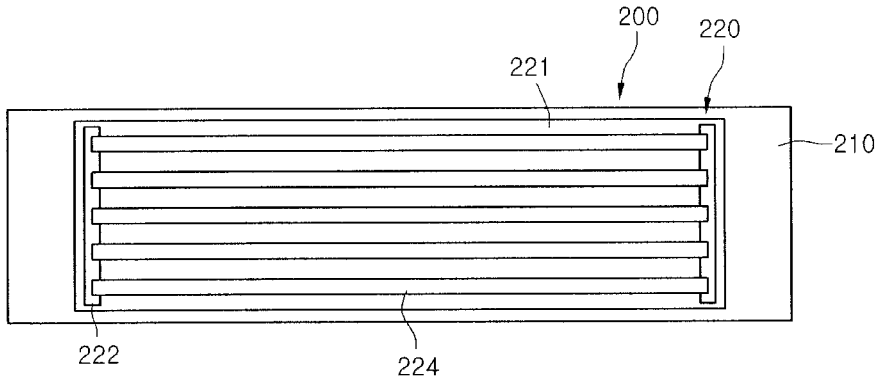
FIG. 9 is a development diagram of one refrigerant pipe according to a fourth embodiment.

FIG. 9 is a development diagram of a refrigerant pipe according to a fourth embodiment.

The configuration of the embodiment is the same as the configuration of the first embodiment but has a difference in the arrangement of the elements configuring the heating unit.

Referring to FIG. 9, a refrigerant heating apparatus 200 according to the present embodiment includes a refrigerant pipe 210 and a heating unit 220. The heating unit 220 includes an insulating sheet 211 that is fixed to the upper surface of the refrigerant pipe 210, a pair of electrodes 222 that are fixed to the upper surface of the insulating sheet 211 and is disposed along the circumference of the refrigerant pipe 200, and a plurality of CNT heating elements 224 having one end connected to one electrode and the other end connected to the other electrode.

The pair of electrodes 222 are disposed to be spaced from each other. The plurality of CNT heating elements 224 are disposed to be spaced from each other and is extended in a length direction of the refrigerant pipe 210.

Figure 10:
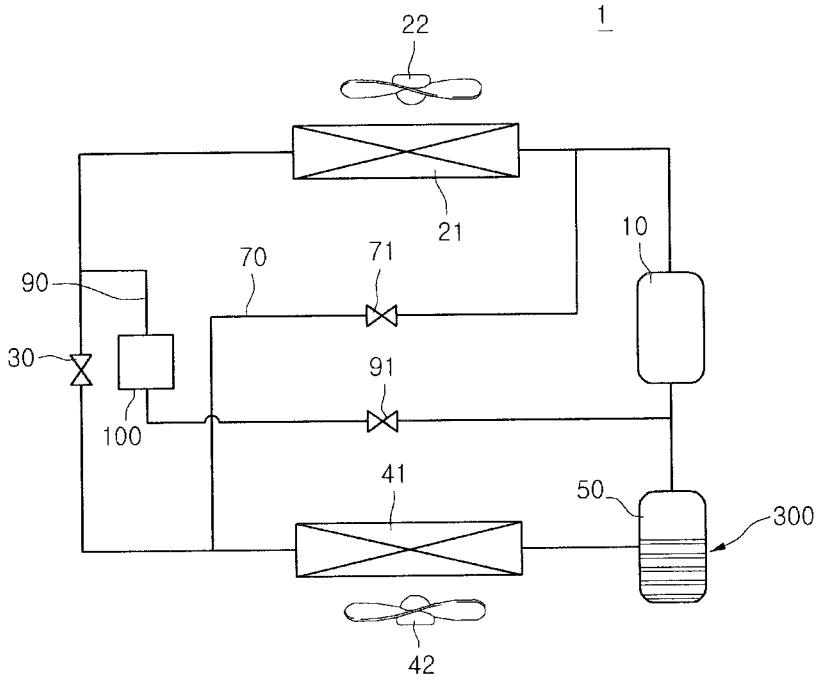
FIG. 10 is a diagram showing a refrigerant cycle of an air conditioner according to a fifth embodiment.

FIG. 10 is a diagram showing a refrigerant cycle of an air conditioner according to a fifth embodiment.

The configuration of the embodiment is the same as the configuration of the first embodiment but has a difference in that the heating unit is additionally provided at the accumulator.

Referring to FIG. 10, the outer surface of the accumulator 50 of the present embodiment is provided with the heating unit 300. The accumulator may be formed in a cylindrical shape as one example and the heating unit may be formed in the same structure as the first embodiment or the fourth embodiment. Therefore, the refrigerant within the accumulator 50 is heated by the heating unit and may be then sucked into the compressor.

Although FIG. 10 shows the heating unit is provided at the accumulator in the state where a separate refrigerant heating apparatus is provided, the refrigerant heating apparatus is removed and the heating unit may be provided at only the outer surface of the accumulator.

The invention claimed is:

1. An air conditioner comprising:

a compressor to compress a refrigerant;

a condenser to condense the refrigerant from the compressor;

an expander to expand the refrigerant from the condenser;

an evaporator to evaporate the refrigerant from the expander;

a refrigerant pipe to bypass the refrigerant from the condenser to an inlet side of the compressor, the refrigerant pipe being formed of one of copper, aluminum and steel;

a valve to control the refrigerant in the refrigerant pipe, an insulating sheet on an outer surface of the refrigerant pipe;

a pair of electrodes on an upper surface of the insulating sheet and connected to a power supply line, the pair of electrodes including a first electrode and a second electrode spaced from the first electrode;

connection members to surround the refrigerant pipe to connect the pair of electrodes to the power supply line, the connection members including a first connection member coupled to the second electrode and a second connection member coupled to the first electrode; and a carbon nanotube heating element on the pair of electrodes to generate heat using power from the pair of electrodes, and wherein the pair of electrodes are between the insulating sheet and the carbon nanotube heating element, a length of the first electrode is shorter than a length of the second electrode, and the second connection member includes a bent portion to prevent the second connection member from contacting the second electrode.

2. The air conditioner according to claim 1, wherein the carbon nanotube heating element comprises:

a first end to electrically connect to the first electrode; and a second end to electrically connect to the second electrode.

3. The air conditioner according to claim 1, further comprising an accumulator to separate a gas refrigerant and a liquid refrigerant, the accumulator being between the evaporator and the compressor, wherein the insulating sheet, the pair of electrodes and the carbon nanotube heating element are provided on an outer surface of the accumulator.

4. The air conditioner according to claim 1, wherein an upper surface of the carbon nanotube heating element is coated with an anti-oxidation layer.

5. The air conditioner according to claim 1, wherein the first and second electrodes extend in a length direction of the refrigerant pipe.

6. The air conditioner according to claim 5, wherein the carbon nanotube heating element is arranged such that the carbon nanotube heating element crosses the pair of electrodes.

7. The air conditioner according to claim 1, wherein the carbon nanotube heating elements are configured in plural and are disposed to be spaced from each other.

8. The air conditioner according to claim 7, wherein a width in a direction of the plurality of carbon nanotube heating elements is formed to be equal to or larger than an interval between adjacent carbon nanotube heating elements.

* * * * *